United States Patent [19]

Fujikawa et al.

[11] 3,977,381

[45] Aug. 31, 1976

[54] EXHAUST GAS RECIRCULATION SYSTEM

[75] Inventors: Yasuo Fujikawa, Tokyo; Yasuo Nakajima, Yokosuka; Yoshimasa Hayashi, Yokohama; Kunihiko Sugihara, Yokohama; Yoshifumi Hase, Yokohama, all of Japan

[73] Assignee: Nissan Motor Co., Ltd., Yokohama, Japan

[22] Filed: Aug. 29, 1974

[21] Appl. No.: 501,849

[30] Foreign Application Priority Data

Aug. 31, 1973 Japan ..... 48-98536

[52] U.S. Cl. ..... 123/119 A

[51] Int. Cl.[2] ..... F02M 25/06

[58] Field of Search ..... 123/119 A

[56] References Cited

UNITED STATES PATENTS

| | | | |
|---|---|---|---|
| 2,720,196 | 10/1955 | Wolf | 123/119 A |
| 2,722,927 | 11/1955 | Cornelius | 123/119 A |
| 3,739,797 | 6/1973 | Caldwell | 123/119 A X |
| 3,768,452 | 10/1973 | Lewis | 123/119 A |
| 3,835,827 | 9/1974 | Wolgemuth | 123/119 A |
| 3,861,642 | 1/1975 | Maddocks | 123/119 A |

FOREIGN PATENTS OR APPLICATIONS

| | | | |
|---|---|---|---|
| 1,601,374 | 4/1970 | Germany | 123/119 A |

*Primary Examiner*—Wendell E. Burns

[57] ABSTRACT

An auxiliary flow control valve is disposed in an exhaust gas recirculation passageway at a location upstream of a main flow control valve controlling the flow rate of exhaust gases recirculated into an intake system. Two conduits communicating with an intake manifold communicate with a vacuum chamber of a servo motor controlling the main flow control valve. One of the conduits has formed therein a restriction to limit the flow rate of fluid therethrough. A check valve is disposed in the other conduit to close the same when the vacuum in the intake manifold is increased and constant and to open the other conduit when the vacuum in the intake manifold is reduced.

4 Claims, 1 Drawing Figure

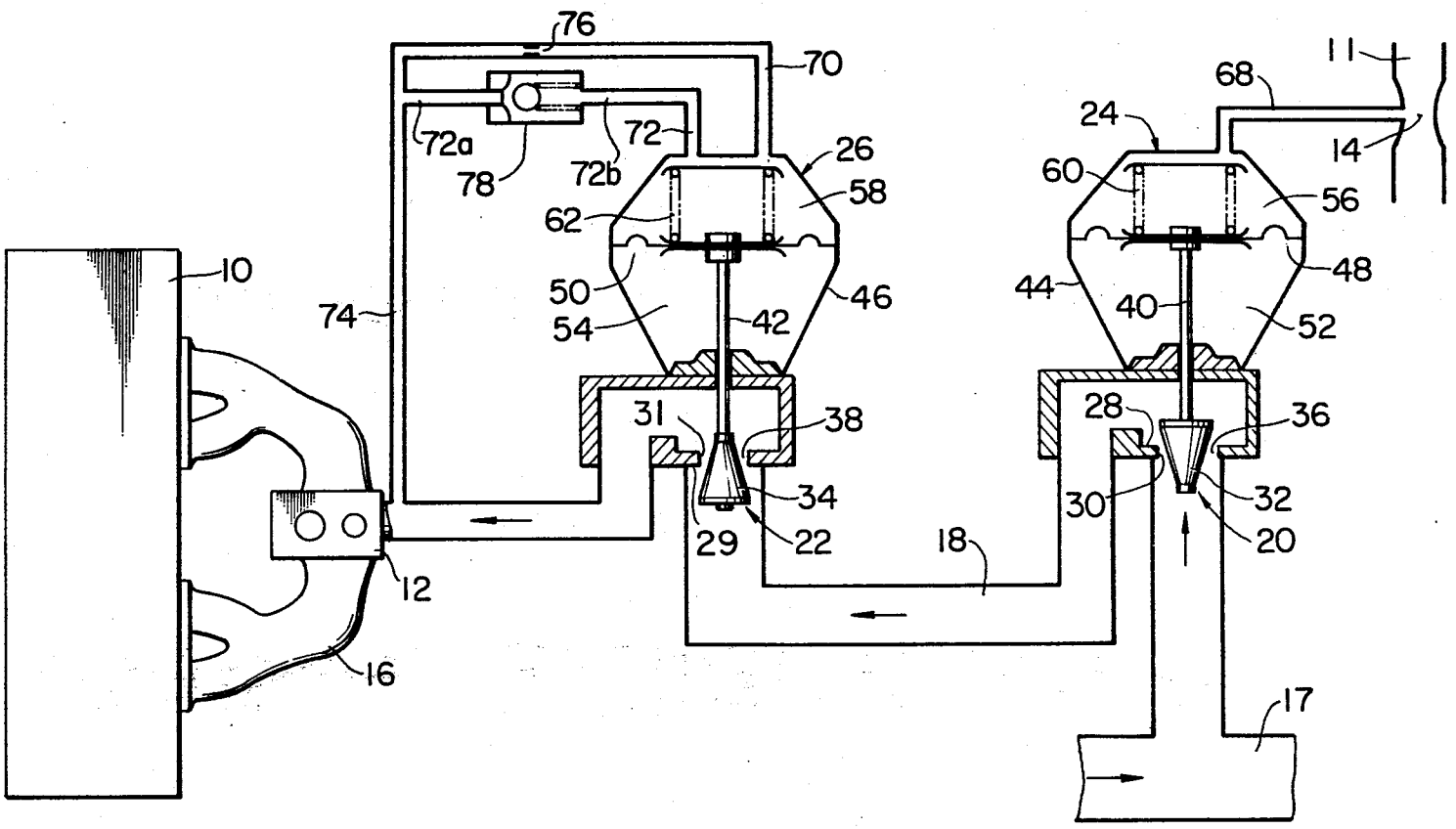
11
14
56
48
52
36
32
20
17
68
24
60
40
44
28
30
18
26
58
46
38
34
22
70
42
29
31
72
72b
62
50
54
76
78
72a
74
12
16
10

EXHAUST GAS RECIRCULATION SYSTEM

The present invention relates generally to an atmospheric pollution reducing system of an internal combustion engine and particularly to an improvement in an exhaust gas recirculation system in an internal combustion engine.

Internal combustion engine have been recently equipped with exhaust gas recirculation systems to recirculate exhaust gases into the intake manifolds as an inert gas for controlling the temperature of combustion of combustible mixtures in engine combustion chambers. The purpose of this is to reduce the production of noxious nitrogen oxides ($NO_x$) which contaminate the atmosphere. In this instance, it is required that the amount of exhaust gases recirculated into the intake manifolds be maintained at an appropriate ratio to that of intake air drawn into the engine combustion chamber. Surpluses and shortages in the amounts of the recirculated exhaust gases relative to that of engine intake air cause deterioration of engine performance and increase the production of nitrogen oxides, respectively.

A conventional exhaust gas recirculation system has been provided with a single valve as an exhaust gas recirculation control valve which is disposed in the exhaust gas recirculation conduit connecting the exhaust conduit to the intake manifold to control or meter the flow of exhaust gases recirculated into the intake manifold and which is operated by the vacuum in the intake manifold. When the single valve is held in a slightly open position in response to high vacuum in the intake manifold, the difference between the pressures upstream and downstream of the valve is excessively increased to increase the flow of recirculated exhaust gases to an undesired high ratio to that of engine intake air. This results in deterioration of engine performance. Furthermore, when the throttle valve is rapidly moved from a partially or fully open position toward a fully closed position for deceleration, although the vacuum in the intake manifold is increased in accordance with movement of the throttle valve, the speed of the engine and accordingly the flow rate of intake air drawn into the engine combustion chamber are not reduced in accordance with movement of the throttle valve but reduced with a time lag due to inertia. In other words, the vacuum in the intake manifold does not vary with the rate of flow of engine intake air, and the rate of increase in the vacuum in the intake manifold is relatively high as compared to that of reduction in the flow rate of engine intake air. Thus, the exhaust gas recirculation valve operated by the vacuum in the intake manifold reduces the flow rate of exhaust gases recirculated into the intake manifold to an undesired low ratio to that of engine intake air during deceleration. This causes increase in the production of nitrogen oxides.

It is, therefore, an object of the invention to eliminate the above-mentioned shortcomings encountered in a conventional exhaust gas recirculation system by providing control means and an auxiliary valve for an exhaust gas recirculation valve.

This and other objects and advantages of the invention will become more apparent from the following detailed description taken in conjunction with the accompanying drawing which shows a schematic cross sectional view of a preferred embodiment of an exhaust gas recirculation system according to the invention.

Referring to the drawing, an engine exhaust gas recirculation system according to the invention is shown as being incorporated into an internal a combustion engine 10 which is provided with an intake system including a combustible mixture intake passageway or conduit 11 leading from the atmosphere to combustion chamber (not shown) of the engine 10, a carburettor 12 through which the intake passageway 11 passes and which has a venturi section 14 formed in the intake passageway 11 and a throttle valve (not shown) rotatably mounted in the intake passageway 11, and an intake manifold 16 constituting part of the intake passageway 11, and an exhaust gas passageway or conduit 17 leading from the engine combustion chamber to the atmosphere.

The exhaust gas recirculation system comprises an exhaust gas recirculation passageway or conduit 18 communicating at one end thereof with the exhaust gas passageway 17 and at the other end thereof with the intake manifold 16 to recirculate at least a portion of engine exhaust gases into the intake manifold 16 from the exhaust gas passageway 17. A first or auxiliary flow control valve or exhaust gas recirculation control valve 20 and a second or main flow control valve or exhaust gas recirculation control valve 22 are provided to control or meter the flow of exhaust gases recirculated into the intake manifold 16 through the exhaust gas recirculation passageway 18 at a predetermined appropriate ratio to that of engine intake air. The second or main flow control valve 22 is located in the exhaust gas recirculation passageway 18 at a location downstream of the first flow control valve 20. First and second servo motors or diaphragm units 24 and 26 are provided to control the first and second flow control valves 20 and 22, respectively. The first and second flow control valves 20 and 22 include partition members 28 and 29 formed in the exhaust gas recirculation passageway 18 and formed therethrough with apertures 30 and 31, respectively, and valve heads or members 32 and 34 which both are in the form of a cone and movably extend through the apertures 30 and 31, respectively. The aperture 30 provides an annular clearance between the partition member 28 and the valve member 32 to form an exhaust gas flow path 36 the effective cross sectional area of which is controlled by the valve member 32. The aperture 31 provides an annular clearance between the partition member 29 and the valve member 34 to form an exhaust gas flow path 38 the effective cross sectional area of which is controlled by the valve member 34. Valve stems or plungers 40 and 42 extend from the valve heads 32 and 34 externally of the exhaust gas recirculation passageway 18, respectively. The first and second servo motors 24 and 26 include casing 44 and 46 fixedly secured to the exhaust gas recirculation passageway 18, and pressure responsive deformable members such as flexible diaphragms 48 and 50 which are deformably disposed in the casings 44 and 46 and to the centers of which the leading ends of the valve stems 40 and 42 are fixedly connected and which divide the interior of the casing 44 and 46 into atmospheric chambers 52 and 54 and vacuum chambers 56 and 58. The valve heads 32 and 34 are arranged relative to the partition members 28 and 29 to reduce and increase the effective cross sectional areas of the flow paths 36 and 38 when the diaphragms 48 and 50 are moved toward the partition members 28 and 29, respectively. Biasing means such as compression springs 60 and 62 are disposed in the vacuum chambers 56 and 58 to urge the diaphragms 48 and 50 toward positions in which the valve heads 32 and 34 reduces and increases the effective cross sectional area of the flow paths 36 and 38, respectively. The atmospheric chambers 52 and 54 are vented to the atmosphere through apertures (not shown) formed in the casings 44 and 46, respectively. The vacuum chamber 56 of the first servo motor 24 communicates with the venturi section 14 in the carburettor 12 by way of a conduit 68. The vacuum chambers 58 of the second servo motor 26 communicates with the exhaust gas recirculation passageway 18 at a location adjacent to the intake manifold 16 by way of two conduits 70 and 72 and a conduit 74 combined thereto. Although the conduit 74 communicates with the recirculation passageway 18, it may directly communicate with the intake manifold 16. The conduit 70 is provided therein with a restriction or orifice 76 to limit the flow of fluid passing through the conduit 70. A check valve 78 is disposed in the conduit 72 to open the same to permit fluid flow from a conduit 72*a* to conduit 72*b* when the vacuum in the intake manifold 16 is reduced at a rate which exceeds a predetermined value and to close the conduit 72 to inhibit fluid flow from the conduit 72*a* to conduit 72*b* when the vacuum in the intake manifold 16 is increased and constant. It will be understood that the conduits 70 and 72, restriction 76 and check valve 78 constitute a one-way damper passage means in which the flow rate of fluid passing therethrough is different in accordance with directions of the fluid flow. Accordingly, the conduits 70 and 72, restriction 76 and check valve 78 may be replaced by, for example, a sole conduit which is provided therein with a check valve of an incompletely closed type. The cross sectional area of the restriction 76 is preferably variable in such a manner that the pressure in the vacuum chamber 58 falls to the level of the vacuum in the intake manifold 16 at the rate of reduction in the flow rate of engine intake air when the check valve 78 is closed and the vacuum in the intake manifold 16 is increased.

The operation of the exhaust gas recirculation system thus constructed is as follows.

A vacuum in the venturi section 14 is varied in accordance with the rate of flow of the air passing therethrough and drawn into the engine combustion chamber throughout all operating conditions of the engine 10. The vacuum thus varied is supplied into the vacuum chamber 56 of the first servo motor 24 by way of the conduit 68. The diaphragm 48 is moved by the pressure differential between the atmospheric and vacuum chambers 52 and 56 overcoming the action of the biasing means 60 so that the valve head 32 is moved relative to the partition member 28 to increase or reduce the effective cross sectional area of the exhaust gas flow path 36 of the first flow control valve 20 in accordance with an increase or reduction in the vacuum in the venturi section 14 and therefore an increase or reduction in the flow rate of the air drawn into the engine combustion chamber. Thus, the first flow control valve 20 is operable to allow a large quantity of engine exhaust gases to the second flow control valve 22 when the degree of opening of the second valve 22 is large and a small quantity of engine exhaust gases to the second valve 22 when the degree of opening of the second valve 22 is small to prevent the pressure differential of the upstream and downstream of the second valve 22 from being excessively increased.

When the vacuum in the intake manifold 16 is constant or is reduced at a rate which is below the predetermined value, the check valve 78 is closed so that the vacuum in the intake manifold 16 is supplied into the vacuum chamber 58 of the second servo motor 26 by way of the conduit 74 and the conduit 70 with the restriction 76 only. The diaphragm 50 is held by the pressure differential between the atmospheric and vacuum chambers 54 and 58 balanced with the action of the biasing means 62 in a position in which the valve head 34 imparts a predetermined effective cross sectional area to the exhaust gas flow path 38 in accordance with the vacuum in the intake manifold 16. Thus, the second flow control valve 22 allows the flow of engine exhaust gases to the intake manifold 16 which flow is at a desired ratio with respect to the flow of the air drawn into the engine 10.

When the vacuum in the intake manifold 16 is reduced at a rate which is above the predetermined value with the throttle valve moved from a fully closed or partially open position toward a fully open position for acceleration of a motor vehicle equipped with the engine 10, the check valve 78 is opened so that sufficient gas flow is obtained the intake manifold 16 and the vacuum chamber 58 by way of the conduit 72 and the conduit 70 with the restriction 76. As a result, the pressure in the vacuum chamber 58 is rapidly increased to the level of the vacuum in the intake manifold 16 at a rate identical with or close to that of reduction in the vacuum in the intake manifold 16 and accordingly of increase in the flow rate of the air taken into the engine 10 thereby reducing the pressure differential between the atmospheric and vacuum chambers 54 and 58. The diaphragm 50 is rapidly bulged toward the atmospheric chamber 54 by the reduced pressure differential between the chambers 54 and 58 and the action of the biasing means 62. As a result, the valve head 34 is rapidly moved to increase the effective cross sectional area of the exhaust gas flow path 38. Thus, the second flow control valve 22 increases the flow rate of recirculated exhaust gases at a rate similar or close to the rate of increase in the flow rate of the air drawn into the engine 10 during acceleration of the engine 10.

When the throttle valve is moved from a partially or fully open position to a fully closed position for deceleration of the vehicle, the vacuum in the intake manifold 16 is increased at a rate which is higher than the rate of reduction in engine speed and accordingly in the flow rate of engine intake air as mentioned hereinbefore. Increase in the vacuum in the intake manifold 16 causes closing of the check valve 78 so that the restriction 76 only provides limited gas flow between the intake manifold 16 and the vacuum chamber 58. The restriction 76 prevents the pressure in the vacuum chamber 58 from being rapidly reduced to the level of the vacuum in the intake manifold 16 at the rate of increase in the vacuum in the intake manifold 16 and causes the pressure in the vacuum chamber 58 to gradually approach the vacuum level in the intake manifold 16 with a time lag at a rate which is lower than that of increase in the vacuum in the intake manifold 16 or at the rate of reduction in the flow rate of engine intake air thereby gradually increasing the pressure differential between the atmospheric and vacuum chambers 54 and 58. The diaphragm 50 is gradually yielding or bulging toward the vacuum chamber 58 by the increased pressure differential between the chambers 54 and 58 against the action of the biasing means 62. As a result, the valve head 34 is moved to gradually reduce the effective cross sectional area of the exhaust gas flow path 38. Thus, the second flow control valve 22 is prevented from rapidly reducing the flow rate of recirculated exhaust gases at the rate of increase in vacuum in the intake manifold 16 and gradually reduces the flow rate of recirculated exhaust gases at the rate of reduction in the flow rate of engine intake air to control the flow rate of exhaust gas recirculated into the intake manifold 16 through the second flow control valve 22 to a desired appropriate ratio to that of engine intake air during deceleration of the engine.

It will be understood that the restriction 76 and the check valve 78 serve as delay means which is operable to delay the transmission of vacuum in the intake manifold 16 to the vacuum chamber 58 of the second diaphragm unit 26 when vacuum in the intake manifold 16 is increased.

It will be also understood that an exhaust gas recirculation system according to the invention has an advantage in that by providing an auxiliary flow control valve located upstream of the main flow control valve controlling the flow rate of exhaust gases recirculated into an engine intake system, the pressure differential between the upstream and downstream of the main flow control valve is prevented from being excessively or undesirably increased when the degree of opening of the main flow control valve is small, and as a result, the flow rate of exhaust gases recirculated into the intake system can be controlled at a desired appropriate ratio to that of engine intake air even when the degree of opening of the main flow control valve is small, and a further advantage is that although the main flow control valve is controlled by a servo motor operated by the vacuum in the intake manifold, by, when the vacuum in the intake manifold is increased, limiting gas flow between the intake manifold and the servo motor so that the main flow control valve is moved at a rate lower than that of increase in the vacuum in the intake manifold, the flow rate of exhaust gases recirculated into the intake manifold can be controlled to a desired appropriate ratio to that of engine intake air without affecting the operation of the main flow control valve during constant speed and accelerating operations of the engine even when the throttle valve is moved toward a fully closed position for deceleration of the engine.

What is claimed is:

1. An exhaust gas recirculation system for an internal combustion engine, comprising an exhaust gas recirculation conduit for interconnecting an exhaust conduit of an internal combustion engine and an intake manifold of said engine to recirculate exhaust gases of said engine into said intake manifold, a main exhaust gas recirculation control valve which is disposed in said recirculation conduit to meter the flow of said exhaust gases recirculated into said intake manifold and is controlled by a diaphragm unit responding to vacuum in said intake manifold and having a vacuum chamber subjected to the vacuum in said intake manifold, and an auxiliary exhaust gas recirculation control valve disposed in said recirculation conduit at a location upstream of said main recirculation control valve to meter the flow of said exhaust gases supplied thereto and operated in response to vacuum in a venturi formed in an intake conduit of said engine, said auxiliary recirculation control valve being operable to increase and reduce the flow of said exhaust gases passing therethrough in accordance with increases and decreases in the vacuum in said venturi, respectively.

2. An exhaust gas recirculation system for an internal combustion engine, comprising an exhaust gas recirculation conduit for interconnecting an exhaust conduit of an internal combustion engine and an intake manifold of said engine to recirculate exhaust gases of said engine into said intake manifold, a main exhaust gas recirculation control valve which is disposed in said recirculation conduit to meter the flow of said exhaust gases recirculated into said intake manifold and is controlled by a diaphragm unit responding to vacuum in said intake manifold and having a vacuum chamber subjected to vacuum in said intake manifold, an auxiliary exhaust gas recirculation control valve disposed in said recirculation conduit at a location upstream of said main recirculation control valve to meter the flow of said exhaust gases supplied thereto and operated in response to vacuum in a venturi formed in an intake conduit of said engine, said auxiliary recirculation control valve being operable to increase and reduce the flow of said exhaust gases passing therethrough in accordance with increases and decreases in the vacuum in said venturi, respectively, and means operable in response to an increase in the vacuum in said intake manifold to delay an increase in vacuum in said vacuum chamber to the level of the vacuum in said intake manifold.

3. An exhaust gas recirculation system as claimed in claim 2, in which said means comprises first and second conduits in parallel with each other and each of which communicates at one end, with said vacuum chamber and is subjected at their respective opposite ends, to the vacuum in said intake manifold, a restriction formed in said first conduit to limit the flow of fluid passing therethrough, and a check valve disposed in said second conduit, said check valve being operable to close said second conduit in response to increases in the vacuum in said intake manifold and open said second conduit in response to decreases in the vacuum in said intake manifold.

4. An exhaust gas recirculation system as claimed in claim 2, in which said auxiliary exhaust gas recirculation control valve comprises a partition member formed in said recirculation conduit and formed therethrough with an aperture, a valve member in the form of a cone and movably extending through said aperture, said aperture providing an annular clearance between said partition member and said valve member to form an exhaust gas flow path, a valve stem extending from said valve member externally of said recirculation conduit, and a diaphragm unit comprising a housing, a flexible diaphragm to which said valve stem is fixedly secured and which divides the interior of said housing into an atmospheric pressure chamber communicating with the outside atmosphere and a vacuum chamber subjected to vacuum in said venturi, said valve member being arranged with respect to said partition member so that increases and decreases in vacuum in the last-mentioned vacuum chamber cause said valve member to increase and reduce the cross sectional area of said exhaust gas flow path, respectively, and biasing means urging said diaphragm in a direction opposed by the pressure in said atmospheric pressure chamber.

* * * * *